US011536017B2

(12) United States Patent
VanHoose et al.

(10) Patent No.: US 11,536,017 B2
(45) Date of Patent: Dec. 27, 2022

(54) MODULAR PRECAST CONCRETE WATER STORAGE DEVICE AND SYSTEM

(71) Applicant: Innovative Design Solutions LLC, Loudon, TN (US)

(72) Inventors: Jeff VanHoose, Loudon, TN (US); Don Atkins, Louisville, TN (US)

(73) Assignee: Envirokeeper, LLC, Loudon, TN (US)

( * ) Notice: Subject to any disclaimer, the term of this patent is extended or adjusted under 35 U.S.C. 154(b) by 0 days.

(21) Appl. No.: 16/913,623

(22) Filed: Jun. 26, 2020

(65) Prior Publication Data

US 2021/0010255 A1 Jan. 14, 2021

Related U.S. Application Data

(63) Continuation-in-part of application No. 15/794,569, filed on Oct. 26, 2017, now abandoned.

(Continued)

(51) Int. Cl.
*E04B 1/04* (2006.01)
*E03F 5/10* (2006.01)

(52) U.S. Cl.
CPC . *E04B 1/04* (2013.01); *E03F 5/10* (2013.01)

(58) Field of Classification Search
CPC .. E04B 1/04; E03F 1/002; E03F 1/003; E03F 1/005; E03F 5/10

(Continued)

(56) References Cited

U.S. PATENT DOCUMENTS 494,576 A ‡ 4/1893 Lewis ..... E01F 5/005 405/125
698,902 A * 4/1902 Budd ..... F16L 9/18 138/117

(Continued)

FOREIGN PATENT DOCUMENTS

DE 3443938 6/1986
DE 3443938 A1 6/1986

(Continued)

OTHER PUBLICATIONS

Dawkins, W. P., "User's Guide: Computer Program for Design or Investigation of Orthogonal Culverts (CORTCUL)", Mar. 1981, www.dtic.mil/get-tr-doc/pdf?AD=ADA 100968.‡

(Continued)

*Primary Examiner* — James M Ference
*Assistant Examiner* — Joseph J. Sadlon
(74) *Attorney, Agent, or Firm* — Blanchard Horton PLLC

(57) ABSTRACT

A modular precast concrete structure system to form a modular precast concrete structure as a portion of a subsurface storage basin is provided, the system including a concrete slab having a first edge and opposite second edge, and a first concrete side wall having an outer surface extending from the first edge substantially perpendicularly to the concrete slab, and a second concrete side wall having an outer surface extending from the second edge substantially perpendicularly to the concrete slab, the outer surfaces of the first and second concrete side walls being configured to be substantially parallel, each of the first and second side walls being configured with canted inner surfaces such that the first and second side walls taper in thickness away from the slab, and a plurality of footings each configured with a footing groove along an upper surface thereof, the footing (Continued)

grooves configured to receive a bottom edge of at least one of the first and second side walls therein.

8 Claims, 7 Drawing Sheets

Related U.S. Application Data

(60) Provisional application No. 62/412,907, filed on Oct. 26, 2016.

(58) Field of Classification Search
USPC ..... 52/223.7; 405/46
See application file for complete search history.

(56) References Cited

U.S. PATENT DOCUMENTS 780,981 A ‡ 1/1905 Daggett ..... E01F 5/005 285/399
862,292 A ‡ 8/1907 Stoffer ..... E04B 7/08 52/89
898,560 A ‡ 9/1908 Crosby ..... E01F 5/005 285/325
925,019 A ‡ 6/1909 Parks et al. ..... E04B 7/08 52/89
1,028,638 A ‡ 6/1912 Thorsby ..... E01F 5/005 405/12
1,060,271 A ‡ 4/1913 Chance et al. ..... E02D 29/067 405/13
1,144,200 A ‡ 6/1915 Hewett ..... E01F 5/005 405/12
1,184,634 A ‡ 5/1916 Duerrwachter ..... E21B 17/046 285/33
1,301,024 A ‡ 4/1919 Wendelken ..... F16L 9/22 138/15
1,349,166 A ‡ 8/1920 Paff ..... E02D 29/0275 405/28
RE15,237 E ‡ 11/1921 Jagdmann ..... 52/204.2
1,412,616 A ‡ 4/1922 Kammerer ..... E01F 5/005 138/10
1,453,136 A ‡ 4/1923 Hitchcock ..... E01F 5/005 405/12
1,572,887 A ‡ 2/1926 Dale ..... E03F 3/04 138/15
1,730,612 A ‡ 10/1929 Hotchkiss ..... E01F 5/005 138/165
1,734,392 A ‡ 11/1929 Moore ..... E01F 5/005 138/15
1,846,147 A ‡ 2/1932 Rogers ..... H02G 3/0418 138/100
1,860,533 A ‡ 5/1932 Fredenhagen ..... F16L 9/003 285/33
1,984,196 A * 12/1934 Moss ..... F16L 9/01 138/100
1,997,236 A * 4/1935 Schroeder, Jr. ..... E01F 5/005 138/158
2,095,024 A ‡ 10/1937 Boosey ..... E03F 5/0409 210/30
2,378,239 A ‡ 6/1945 Myron ..... C02F 3/10 210/293
2,645,114 A ‡ 7/1953 Amirikian ..... E04B 1/348 114/267
2,708,780 A * 5/1955 Burkhalter ..... B28B 7/22 249/99
2,900,083 A ‡ 8/1959 Oliver ..... B01D 24/14 210/29
3,017,033 A ‡ 1/1962 Schreiber ..... C02F 3/10 210/293
3,201,907 A * 8/1965 Henderson ..... E04B 1/34823 52/79.5
3,287,865 A * 11/1966 Lockman ..... E04H 13/006 52/136
3,339,366 A ‡ 9/1967 Gogan ..... C02F 3/10 405/36
3,510,997 A * 5/1970 Ratych ..... E04B 1/34823 52/79.2
3,562,969 A * 2/1971 Little, Jr. ..... E02D 29/12 D25/35
3,570,251 A ‡ 3/1971 Roberts ..... E02B 11/005 405/46
3,645,100 A ‡ 2/1972 La Monica ..... E02B 13/00 405/46
3,696,177 A ‡ 10/1972 Holland ..... E04G 11/34 264/32
3,698,177 A 10/1972 Nyfeler
3,724,141 A * 4/1973 Kelleher ..... E04B 1/34823 52/79.11
3,741,515 A * 6/1973 Rice ..... B28B 7/08 249/26
3,742,660 A ‡ 7/1973 Bierweiler ..... E04B 1/34823 52/79
3,778,528 A ‡ 12/1973 Heifetz ..... E04B 1/34846 52/220
3,871,146 A ‡ 3/1975 Hamy ..... E01D 1/00 52/79
3,879,914 A ‡ 4/1975 Haller ..... B28B 1/087 52/223.7
3,878,656 A ‡ 5/1975 Duwe ..... E04H 13/006 52/134
3,891,178 A * 6/1975 Kelsey ..... B28B 7/0088 249/91
3,908,324 A ‡ 9/1975 Stout ..... E04B 1/18 52/100
3,910,051 A * 10/1975 Komisarek ..... E03F 1/002 405/36
3,918,222 A ‡ 11/1975 Bahramian ..... E04B 5/04 29/452
RE29,249 E * 6/1977 Rice ..... E04B 1/06 52/223.7
4,048,772 A ‡ 9/1977 Gaul ..... E04H 13/006 52/136
4,050,215 A ‡ 9/1977 Fisher ..... E04B 1/34815 52/79
4,096,068 A ‡ 6/1978 Walker ..... B01D 24/24 210/29
4,132,046 A * 1/1979 Duwe ..... E04H 13/006 249/156
4,141,666 A ‡ 2/1979 DeGraff ..... E03F 5/00 405/12
4,143,193 A ‡ 3/1979 Rees ..... B29C 33/14 220/55
4,173,103 A * 11/1979 Sargis ..... E04C 2/30 52/234
4,192,628 A ‡ 3/1980 Gorman ..... E03F 1/003 405/45
4,211,504 A ‡ 7/1980 Sivachenko ..... E01D 19/125 405/12
4,219,978 A ‡ 9/1980 Brown ..... E04B 1/04 52/125.4
4,231,199 A * 11/1980 Gomez ..... E04B 1/04 52/204.2
4,239,416 A ‡ 12/1980 Borca ..... B65G 5/00 220/62
4,290,246 A * 9/1981 Hilsey ..... E04H 3/00 D25/19
4,313,692 A ‡ 2/1982 Johnson ..... E03F 1/002 405/43
4,314,775 A ‡ 2/1982 Johnson ..... F16L 1/036 138/10
4,342,475 A ‡ 8/1982 Moran ..... H02G 9/06 174/71 R
4,365,911 A ‡ 12/1982 Rossberg ..... E01C 11/227 404/2
4,431,337 A ‡ 2/1984 Iwasa ..... E02B 3/06 405/30
4,459,063 A ‡ 7/1984 Shaw ..... E04B 5/32 405/12

(56) References Cited

U.S. PATENT DOCUMENTS 4,490,075 A * 12/1984 Risi ..... E02D 29/0216 405/273
4,523,613 A ‡ 6/1985 Fouss ..... E02B 11/005 138/12
4,539,780 A ‡ 9/1985 Rice ..... E04H 9/12 52/169
4,595,314 A ‡ 6/1986 Lockwood ..... E01F 5/005 405/12
4,638,920 A ‡ 1/1987 Goodhues, Jr. ..... B65D 88/76 220/56
4,650,369 A ‡ 3/1987 Thomas ..... E01F 5/005 405/12
4,669,240 A * 6/1987 Amormino ..... E04B 1/04 52/745.1
4,687,371 A ‡ 8/1987 Lockwood ..... E01F 5/005 405/12
4,751,945 A ‡ 6/1988 Williams ..... F17D 5/04 138/108
4,759,661 A ‡ 7/1988 Nichols ..... E03F 1/003 138/10
4,797,030 A ‡ 1/1989 Lockwood ..... E01F 5/005 405/12
4,854,775 A ‡ 8/1989 Lockwood ..... E01F 5/005 405/12
4,873,796 A * 10/1989 Akmese ..... E04B 1/3211 52/81.4
4,923,606 A ‡ 5/1990 Gresh ..... B01D 24/4631 210/27
4,940,359 A ‡ 7/1990 Van Duyn ..... E01C 11/227 404/2
4,953,280 A ‡ 9/1990 Kitzmiller ..... B28B 7/0029 249/11
4,983,070 A * 1/1991 Hwang ..... E01F 5/005 405/149
4,987,707 A * 1/1991 Kiselev ..... E04B 1/3211 52/82
4,993,872 A ‡ 2/1991 Lockwood ..... E01F 5/005 405/12
5,040,921 A * 8/1991 Torok ..... E02D 29/05 405/150.1
5,081,805 A * 1/1992 Jazzar ..... E04B 1/34823 52/79.14
5,086,594 A ‡ 2/1992 Florence ..... E03F 1/002 210/165
5,129,756 A ‡ 7/1992 Wheeler ..... E02B 3/06 405/21
5,243,794 A * 9/1993 Pikor ..... E04H 13/006 52/136
5,259,586 A * 11/1993 Miller, Sr. ..... B28B 7/0011 249/101
5,326,191 A ‡ 7/1994 Wilson ..... E01F 5/005 285/903
5,336,017 A ‡ 8/1994 Nichols ..... E02B 13/00 405/43
5,401,116 A ‡ 3/1995 Nichols ..... E02B 13/00 405/12
5,481,845 A ‡ 1/1996 Koenig, Jr. ..... E04B 9/30 52/287
5,529,436 A * 6/1996 Meyers ..... E01C 11/227 404/4
5,536,113 A ‡ 7/1996 McGregor ..... E01F 5/005 405/12
5,599,136 A ‡ 2/1997 Wilke ..... E02B 3/12 405/15
5,624,204 A ‡ 4/1997 Dorsemaine ..... E03F 5/101 405/36
5,680,735 A * 10/1997 Bates ..... E04B 2/16 52/220.2
5,697,736 A ‡ 12/1997 Veazey ..... E02D 29/02 405/21
5,720,577 A ‡ 2/1998 Sanders ..... E01F 5/005 405/12
5,810,510 A ‡ 9/1998 Urriola ..... E02B 11/005 405/45
5,836,716 A ‡ 11/1998 Johnson ..... E02B 11/005 405/43
5,836,717 A * 11/1998 Bernini ..... E01F 5/00 405/125
D406,902 S ‡ 3/1999 Lockwood ..... D25/1
5,890,838 A ‡ 4/1999 Moore, Jr. ..... E03F 1/003 405/43
5,946,872 A * 9/1999 Pardo ..... E04B 5/046 52/437
6,004,067 A ‡ 12/1999 Peppard ..... E02B 3/108 405/52
6,032,421 A * 3/2000 Yamada ..... E04G 21/161 220/4.26
6,092,962 A ‡ 7/2000 Lee ..... F16L 25/0018 405/12
6,125,597 A * 10/2000 Hoffman ..... E02D 27/02 52/169.12
6,129,484 A ‡ 10/2000 Chiaves ..... E01D 4/00 405/126
6,203,245 B1 ‡ 3/2001 Harten ..... E01F 5/005 138/10
6,221,445 B1 ‡ 4/2001 Jones ..... E01C 13/08 405/36
6,231,272 B1 * 5/2001 Bishop ..... E02D 29/02 405/284
6,277,274 B1 ‡ 8/2001 Coffman ..... B01D 24/205 210/15
6,322,288 B1 ‡ 11/2001 DiTullio ..... E03F 1/003 138/12
6,361,248 B1 ‡ 3/2002 Maestro ..... E03F 1/003 138/10
6,367,215 B1 * 4/2002 Laing ..... E04C 2/04 52/157
6,368,017 B2 ‡ 4/2002 Black ..... E02D 29/0208 210/17
6,640,505 B1 * 11/2003 Heierli ..... E02D 29/045 52/169.14
6,679,653 B1 ‡ 1/2004 DiTullio ..... E02B 11/005 405/45
6,769,662 B2 * 8/2004 Garza ..... E01F 5/005 249/10
6,991,402 B2 * 1/2006 Burkhart ..... E03F 1/005 405/126
7,080,480 B2 ‡ 7/2006 Urban ..... A01G 13/0237 210/170.03
7,137,756 B1 ‡ 11/2006 Jones ..... E01F 5/005 405/126
7,160,058 B2 ‡ 1/2007 Burkhart ..... E03F 1/005 405/12
7,305,798 B1 * 12/2007 Heierli ..... E01D 4/00 405/125
7,344,335 B2 ‡ 3/2008 Burkhart ..... E03F 1/005 405/12
7,530,764 B1 ‡ 5/2009 Gallegos ..... E01F 5/005 405/125
7,651,298 B2 ‡ 1/2010 Boudreaux, Jr. ..... E02B 3/108 405/11
7,770,250 B2 * 8/2010 Boresi ..... E01F 5/005 14/24
8,127,505 B2 ‡ 3/2012 Lu ..... E04B 1/0023 52/220.2
8,381,485 B2 ‡ 2/2013 Platt ..... B28B 7/164 14/74.5
8,402,706 B2 * 3/2013 Fernandez Fernandez ..... E04G 21/142 52/271
8,523,486 B2 * 9/2013 Aston ..... E01F 5/005 405/126
8,720,130 B2 * 5/2014 Weber ..... E04B 2/44 52/564
8,734,051 B2 * 5/2014 Kerkhoff ..... F16L 3/00 405/43
8,770,890 B2 * 7/2014 May ..... E01F 5/005 405/126

(56) References Cited

U.S. PATENT DOCUMENTS

| | | | | |
|---|---|---|---|---|
| 8,925,282 | B2 * | 1/2015 | Aston | E01D 19/00 52/742.1 |
| 8,985,897 | B2 ‡ | 3/2015 | Boulton | E03B 11/14 405/36 |
| D745,186 | S ‡ | 12/2015 | Aston | D25/1 |
| D751,216 | S ‡ | 3/2016 | Aston | D25/1 |
| 9,428,880 | B2 ‡ | 8/2016 | May | E03F 1/002 |
| 9,481,968 | B2 * | 11/2016 | Aston | E01F 5/005 |
| 9,546,044 | B2 ‡ | 1/2017 | Boulton | B65G 5/005 |
| 9,580,899 | B2 ‡ | 2/2017 | Rotondo | E03F 1/003 |
| 9,982,425 | B2 ‡ | 5/2018 | Vitarelli | H02G 3/0418 138/100 |
| 10,415,241 | B2 * | 9/2019 | Simonson | E04C 5/01 |
| 10,518,440 | B2 * | 12/2019 | Kloet | E01F 5/005 |
| 10,538,384 | B2 * | 1/2020 | Crowther | B28B 7/22 249/99 |
| 2002/0152708 | A1 ‡ | 10/2002 | Kimura | B28B 7/28 52/596 |
| 2004/0182017 | A1 ‡ | 9/2004 | Heierli | E02D 29/05 52/86 |
| 2009/0049776 | A1 ‡ | 2/2009 | Lim | E04C 2/06 52/223.7 |
| 2014/0105684 | A1 ‡ | 4/2014 | Allard | E03F 1/005 405/52 |
| 2015/0033644 | A1 * | 2/2015 | Mesquita E Silva Ferreira De Araujo | E04C 2/06 52/220.1 |
| 2016/0116112 | A1 * | 4/2016 | Bradfield | E03F 1/005 52/578 |

FOREIGN PATENT DOCUMENTS

| | | | | |
|---|---|---|---|---|
| DE | 3443938 | A1 ‡ | 6/1986 | E04B 1/34823 |
| DE | 3522501 | ‡ | 1/1987 | |
| DE | 3522501 | A1 | 6/1987 | |
| DE | 10318982 | A1 * | 11/2004 | B65D 90/022 |
| GB | 16232 | ‡ | 1/1913 | |
| GB | 191216232 | A | 4/1913 | |
| WO | 9512034 | | 5/1995 | |
| WO | 1995012034 | A1 | 5/1995 | |
| WO | WO 95/12034 | ‡ | 5/1995 | |
| WO | 1998054419 | A2 | 12/1998 | |
| WO | WO 98/54419 | ‡ | 12/1998 | |
| WO | 0069539 | | 11/2000 | |
| WO | WO 00/69539 | ‡ | 11/2000 | |
| WO | 2015022444 | A1 | 2/2015 | |
| WO | WO 2015-022444 | | 2/2015 | |
| WO | WO-2015022444 | A1 ‡ | 2/2015 | E04B 1/34823 |
| WO | 2016137218 | A1 | 9/2016 | |
| WO | WO 2016-137218 | | 9/2016 | |
| WO | WO-2016137218 | A1 ‡ | 9/2016 | E01C 11/22 |

OTHER PUBLICATIONS

Shinde, P.S.,"Mult-Use of Stormwater Detention Ponds in Parks and Open Spaces",(Doctoral Dissertation,UGA) 2002, https://getd.libs.uga.edu/pdfs/shindepallavi_s_200212_mla.pdf.‡

Musser, Samuel C., "A Synthesis of the Application and Performance of Three-Sided Precast Box Culverts", Utah Department of Transportation, Feb. 2002, Report No. UT-02.05.‡

Cook, Ronald A., et al., "Evaluation of Precast Box Culvert Systems", Final Report of UF Project No. 4910 4504 857 12, sponsored by the Florida DOT. Mar. 2002.‡

Hicks Tyson, et al., "Twin Cell Precast Concrete Box Culvert Minimizes Environmental Impact", Concrete Pipe News, (2001, Fall). vol. 53(3), pp. 5-6.‡

Hill, J. J., "Construction and Field Evaluation of Precast Concrete Arch Structures", Transportation Research Record: Journal of the Transportation Research Board, 1985, vol. 1008, pp. 94-104.‡

Illinois Department of Transportation, Standard 602101-01, Jan. 1, 1997, 1 page.‡

Illinois Department of Transportation, Standard 602006, Jan. 1, 1997, 1 page.‡

Mar-Mac Manufacturing, Inc., Advertisement, including photographs and drawings for assembly installed and completed near O'Hare Airport in 2001, 9 pages.‡

Drawings of the Channelside Cruise Terminal, Tampa Bay, FL, 2001, 4 pages.‡

Hicks, Tyson H., "Reinforced Concrete Box Culvert System Solves Ten-Year Drainage Problem", Concrete Pipe News, (2001, Spring). vol. 53(1), pp. 5-7.‡

Stormtrap drawings prepared by ECOCAST Ltd., for installation in Plainfield, IL, Aug. 1998, 9 pages.‡

StormTrap advertisements, StormTrap web site, Feb. 2002, 26 pages.‡

Invisible Structures, Inc., "Total Stormwater Management", Advertisement, Stormwater, Sep./Oct. 2002, p. 35.‡

Tilton, Joseph Lynn, "Helping Stormwater Keep Its Place", Stormwater, Sep./Oct. 2002, pp. 40-41, 44-46, 48-51.‡

CONTECH Construction Products Inc., "Meet NPDES Requirements with CONTECH's Stormwater Treatment Train of Structural BMPs", Advertisement, Stormwater, Sep./Oct. 2002, pp. 42-43.‡

Stormtrap, "Modular Storm Water Detention System", Advertisement, Stormwater, Sep./Oct. 2002, p. 47.‡

StormTech, "Profit from the ground up with StormTech's gold chambers", Advertisement, Stormwater, Sep./Oct. 2002, p. 11.‡

Hydrologic Solutions, "StormChamber the Most Effective BMP!", Advertisement, Stormwater, Sep./Oct. 2002, p. 34.‡

Advanced Drainage Systems, Inc., "When was the last time a footprint meant so much?", Advertisement, Stormwater, Sep./Oct. 2002, p. 3.‡

City of Chicago Department of Aviation, drawing of project installed at Midway Airport, Oct. 16, 2002, 1 page.

Andoh,R.Y., et al., "A Novel Integrated System for Stormwater Management", Novatech: 4th Int. Conf. on Innovative Technologies in Urban Drainage, Lyon, France, Jun. 2001, pp. 433-440, https://www.researchgate.net/profile/Mike_Faram/publication/270685632_A_novel_integrated_system_for_stormwater_management.

Wilson, S., et al., "Sustainable Drainage Systems. Hydraulic, Structural and Water Quality Advice", CIRIA C609, Loudon, 2004. http://globalsynthetics.co.nz/files/techincal_downloads/Tech_CIRIA_13.pdf.

ASTM Standard PS62-97, "Provisional Standard Specification for Precast Reinforced Concrete Box Sections for Culverts, Storm Drains, and Sewers", (Withdrawn 1999) ASTM International, West Conshohocken, PA, 1997, www.astm.org.

ASTM Standard C789M-98, "Standard Specification for Precast Reinforced Concrete Box Sections for Culverts, Storm Drains, and Sewers [Metric]", (Withdrawn 2000) ASTM International, West Conshohocken, PA, 1998, www.astm.org.

McGrath, T., et al., "Structural Behavior of Three-Sided Arch Span Bridge", Transportation Research Record: Journal of the Transportation Research Board, 1996, vol. 1541, pp. 112-119.

Carfagno, M. G., et al., "Brush Creek Improvements Double Cell Arch Culvert Installation in Prairie Villiage, Kansas", Transportation Research Record: Journal of the Transportation Research Board, 1997, vol. 1591, pp. 194-199.

James, R. W., "Behavior of ASTM C 850 Concrete Box Culverts Without Shear Connectors", Transportation Research Record: Journal of the Transportation Research Board, 1984, vol. 1001, pp. 104-111.

Beach, T.J., "Load Test Report and Evaluation of a Precast Concrete Arch Culvert", Transportation Research Record: Journal of the Transportation Research Board, 1988, vol. 1191, pp. 12-21.

Hurd, J. O., "Field Performance of Precast Reinforced Concrete Box Culverts", Transportation Research Record: Journal of the Transportation Research Board, 1991, vol. 1315, pp. 53-57.

Little, B. E., "Evaluation of Shear Plates and Grouted Shear Key Joint Performance of a Three-Sided Precast Culverts", Transportation Research Record: Journal of the Transportation Research Board, 1991, vol. 1315, pp. 15-20.

Hill, J. J., et al., "First Precast Concrete Box Culverts in Minnesota", Transportation Research Record: Journal of the Transportation Research Board, 1995, vol. 1514, pp. 22-28.

(56) References Cited

OTHER PUBLICATIONS

Hurd, J., "Eliminating Shear Connectors Slashes Culvert Cost", TR News: Transportation Research Board, Sep.-Oct. 1988, Issue 138, pp. 14-15.
Split Culvert drawing prepared by Oldcastle Precast, 2016, 1 page.
Type 2 Box Culvert drawing prepared by Oldcastle Precast, Mar. 2005, 1 page.
"Standard Specification for Precast Reinforced Concrete Box Sections for Culverts, Storm Drains, and Sewers [Metric] (Withdrawn 2000)", Sep. 7, 2017, 2 Pages.
"When Was the Last Time a Footprint Meant so Much?", 1 Page.
Andoh, Robert Y, et al., "A novel integrated system for stormwater management", Jun. 2001, 9 Pages.

* cited by examiner
‡ imported from a related application

MODULAR PRECAST CONCRETE WATER STORAGE DEVICE AND SYSTEM

CROSS-REFERENCE TO RELATED APPLICATIONS

This application is a continuation-in-part of U.S. patent application Ser. No. 15/794,569, filed on Oct. 26, 2017, which claimed the benefit of U.S. Provisional Patent Application Ser. No. 62/412,907, filed on Oct. 26, 2016, the contents of which are incorporated herein in their entirety by reference.

BACKGROUND OF THE INVENTION

1. Field of Invention

The present general inventive concept relates to surface water runoff collection, storage, filtration, and distribution. More particularly, the present general inventive concept relates to a system of precast concrete units which may be used, solely or in combination with other elements, to create a subsurface system for surface water runoff collection, storage, filtration, distribution, and/or treatment.

2. Description of the Related Art

In the design of buildings and other structures, it is generally known to provide surface water collection systems for the collection of surface water runoff, of the type that occurs when excess stormwater, meltwater, or other water flows over the structure and/or surrounding area. Conventional surface water collection systems comprise gutters, culverts, ditches, and other channels configured to direct the flow of water from a collection area, such as for example a building roof, parking lot, field, or the like; to a storage basin, natural water source, treatment facility, or other destination. In several conventional surface water collection system designs, water which is collected from a collection area is first directed to a storage basin, such as for example an open-air detention pond, where it can be allowed to infiltrate the ground and/or may be released from the storage basin at a controlled rate.

Open-air detention ponds of the type discussed above consume valuable land area and, depending on placement, can disrupt the architectural utility and aesthetic of the surrounding area of a building. Additionally, water stored in open-air detention ponds can become stagnant, which in the presence of sunlight and ambient air may lead to the growth of algae, bacteria, and other harmful microbes and can become a habitat for mosquitoes and other pests. For this and other reasons, numerous designs exist for subsurface water storage systems which provide a subsurface basin for the collection of surface water runoff. These subsurface basins may be buried beneath buildings, parking lots, or other structures, and may provide for the storage of surface water runoff and subsequent ground infiltration and/or distribution of such stored water. Certain more discreet designs may additionally provide for the reclamation and re-use of such stored water for non-potable functions, so-called "grey water" reclamation. The application of grey water reuse in urban water systems provides substantial benefits for both the water supply subsystem, by reducing the demand for fresh clean water, and the wastewater subsystem, by reducing the amount of wastewater required to be conveyed and treated.

Several designs exist for modular precast concrete structures which may be combined to form a subsurface storage basin for surface water runoff. Such modular precast concrete structures typically comprise a slab of concrete supported by a plurality of walls. In some designs, a floor structure is provided to limit infiltration of stored water into the ground, thereby allowing for grey water reclamation of the stored water. In other designs, the walls may rest above a porous subsurface, such as for example gravel, sand, or the like. Thus, surface water runoff within the structure is permitted to infiltrate the ground and return to the environment. Such modular precast concrete structures are typically placed in a side-by-side fashion, such that the various upper concrete slabs cooperate to form an upper support surface for supporting a building structure, such as a parking lot, garage, building, etc., above the subsurface storage basin. In such configurations, the side walls of the various modular precast concrete structures cooperate to support the loads placed above the storage basin.

Modular precast concrete structures for use in fabricating subsurface storage basins for storing surface water runoff are typically designed to allow for the support of a wide variety of loads above the finished storage basin, from relatively lightweight parking lots and fields to significantly heavier structures, such as buildings, parking garages, and the like. Thus, when using modular precast concrete structures for the fabrication of a subsurface storage basin intended to support only a lightweight load, such as a parking lot, the support walls of the finished subsurface storage basin are often overdesigned. In other words, the walls forming the finished subsurface storage basin are significantly thicker and more closely spaced together, and hence comprise significantly more concrete and other raw materials, than is necessary to support the intended load above the subsurface storage basin. Hence, while such prior art modular precast concrete structures are often relatively quick and convenient to install, the use of such structures often involves the expensive and wasteful overuse of concrete materials. Additionally, such prior art modular precast concrete structures are often large and cumbersome, and are therefore difficult and expensive to transport from a place of manufacture to a desired installation site.

In light of the above, there is a need in the art for an improved modular precast concrete structure which may be used in the fabrication of subsurface storage basins, and which allows for the design of subsurface storage basins employing less raw materials than basins designed using conventional modular precast concrete structures. There is a further need in the art for apparatus and methods to allow for more convenient manufacturing of modular precast concrete structures for use in the fabrication of such subsurface storage basins, which will allow for reduced transportation cost of the finished modular precast concrete structures.

BRIEF SUMMARY

According to various example embodiments of the present general inventive concept, a modular precast concrete structure to form a portion of a subsurface storage basin, a system using such a structure, and a method of forming the structure, is provided. The structure has a configuration to aid in the forming of a subsurface storage basin with reduced construction materials. A method of forming the modular precast concrete structure provides an easier extraction of the structure from a forming mold.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a modular precast concrete structure to form a portion of a subsurface storage basin, the structure including a concrete slab having a first edge and opposite second edge, and a first concrete side wall having an outer surface extending from the first edge substantially perpendicularly to the concrete slab, and a second concrete side wall having an outer surface extending from the second edge substantially perpendicularly to the concrete slab, the outer surfaces of the first and second concrete side walls being configured to be substantially parallel, each of the first and second side walls being configured with canted inner surfaces such that the first and second side walls taper in thickness away from the slab.

The foregoing and/or other aspects and advantages of the present general inventive concept may be achieved by providing a modular precast concrete structure system to form a modular precast concrete structure as a portion of a subsurface storage basin, the system including a concrete slab having a first edge and opposite second edge, a first concrete side wall having an outer surface extending from the first edge substantially perpendicularly to the concrete slab, and a second concrete side wall having an outer surface extending from the second edge substantially perpendicularly to the concrete slab, the outer surfaces of the first and second concrete side walls being configured to be substantially parallel, each of the first and second side walls being configured with canted inner surfaces such that the first and second side walls taper in thickness away from the slab, and a plurality of footings each configured with a footing groove along an upper surface thereof, the footing grooves configured to receive a bottom edge of at least one of the first and second side walls therein.

The foregoing and/or other aspects and advantages of the present general inventive concept may also be achieved by a forming apparatus to precast a modular concrete structure used to form a portion of a subsurface storage basin, the forming apparatus including a bottom surface configured form a bottom portion of the modular concrete structure, two outer side wall members configured to form substantially vertical outer surfaces of opposing side walls of the modular concrete structure, two inner side wall members respectively facing the two outer side wall members and configured to form canted inner surfaces of the opposing side walls of the modular concrete structure so that the side walls taper in thickness toward the bottom portion of the modular concrete structure, and a top member configured to form a concrete slab having a first edge and opposite second edge from which the opposing side walls of the modular concrete structure respectively extend to the bottom portion of the modular concrete structure.

The foregoing and/or other aspects and advantages of the present general inventive concept may also be achieved by a method of forming a modular concrete structure used to form a portion of a subsurface storage basin, the method including providing a bottom surface configured to form a bottom portion of the modular concrete structure, providing two outer side wall members extending from the bottom surface and configured to form substantially vertical outer surfaces of opposing side walls of the modular concrete structure, providing two inner side wall members extending from the bottom surface and respectively facing the two outer side wall members, the inner side wall members configured to form canted inner surfaces of the opposing side walls of the modular concrete structure so that the side walls taper in thickness toward the bottom portion of the modular concrete structure, providing a top member extending between the inner side wall members and configured to form a concrete slab having a first edge and opposite second edge from which the opposing side walls of the modular concrete structure respectively extend to the bottom portion of the modular concrete structure; and pouring concrete over the top member and between the respective outer and inner side wall members until a desired thickness of the formed concrete slab is reached.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of various example embodiments, with reference to the accompanying drawings in which.

DETAILED DESCRIPTION

Reference will now be made to the example embodiments of the present general inventive concept, examples of which are illustrated in the accompanying drawings, illustrations, and photographs. The example embodiments are described herein in order to explain the present general inventive concept by referring to the figures.

The following detailed description is provided to assist the reader in gaining a comprehensive understanding of the structures, system, and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a modular precast concrete structure is provided which is useful, for example, in the fabrication of a subsurface water storage basin. Various example embodiments of the present general inventive concept provide a system using such a structure along with footings also configured according to the present general inventive concept. Various example embodiments of the present general inventive concept may provide tapered sidewalls to provide easier extraction from a forming mold. Various example embodiments of the present general inventive concept may provide mating structures at opposite ends of the structures such that a series of the structures may be fitted in register to form a length of combined structures. Various example embodiments of the present general inventive concept may provide these and/or other features as discussed herein, or which may be recognized from the descriptions thereof.

Figure 1:
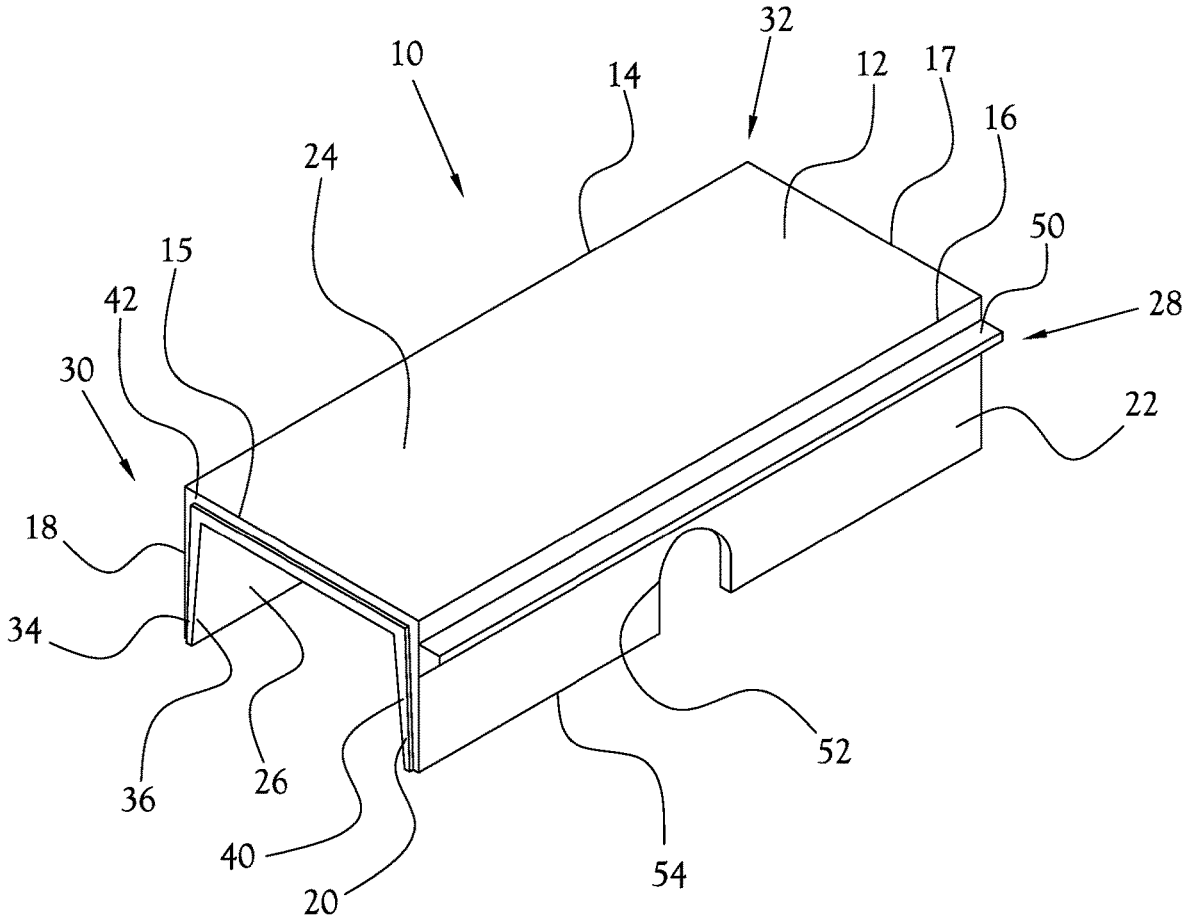
FIG. 1 illustrates a modular precast concrete structure according to an example embodiment of the present general inventive concept.

FIG. 1 illustrates a modular precast concrete structure according to an example embodiment of the present general inventive concept. This example embodiment of the modular precast concrete structure, or "module," is illustrated generally at 10. With reference to the attached figures, in one embodiment, the module 10 includes generally a rectangular upper slab 12 supported along respective opposite first and second edges thereof 14, 16 by a pair of integrally-formed walls 18, 20. The slab 12 and walls 18, 20 cooperate to form an enclosure having an open floor and respective first and second open ends 30, 32. Thus, as will be further discussed below, multiple modules 10 may be placed in an end-to-end configuration to create a combined structure defining a continuous upper concrete slab and a single, unitary interior space therebeneath. Furthermore, as will be discussed herein, each module 10 may define at least one bearing ledge 28 extending generally horizontally along an outer surface of a corresponding wall 18, 20. Each module 10, or row of end-to-end modules, may be placed in a side-by-side, spaced apart configuration with another module 10, or row of end-to-end modules, with pairs of cooperating bearing ledges 28 facing one another in a parallel, spaced apart configuration. In this configuration, one or more concrete spanning slabs may be placed spanning between, and supported by, cooperating bearing ledges 28. Thus, a continuous concrete structure may be formed by and between side-by-side, spaced apart modules 10, or rows of modules, having a continuous upper concrete slab formed by adjacent upper slabs 12 of the modules 10 and adjacent spanning slabs. Suitable through openings may be defined by the modules 10 such that the interior spaces of the various modules 10 are in fluid communication with the space beneath the spanning slabs, such that a single, unitary interior space is formed beneath the continuous upper concrete slab which is suitable for the receipt and storage of surface water runoff therein. By determining a desired width between side-by-side, spaced apart modules 10, or rows of modules, and thus by determining a desired width of the spanning slabs, a subsurface storage basin may be designed having a desired support strength while employing a minimum amount of materials in the various walls and slabs of the storage basin.

With further reference to FIG. 1, in one example embodiment a module 10 is provided having generally a rectangular slab 12 defining oppositely disposed first and second edges 14, 16, with third and fourth edges 15, 17 extending between respective ends of the first and second edges 14, 16. A pair of oppositely disposed walls 18, 20 are provided, each wall 18, 20 being integrally formed along a respective one of opposite first and second edges 14, 16 of the slab 12. Each wall 18, 20 extends in a generally parallel-planar, spaced apart relationship to one another, and each wall 18, 20 defines a substantially vertical outer surface 22 extending substantially perpendicularly downward from an upper surface 24 of the slab 12. In the illustrated embodiment, each respective inner surface 26 of each wall 18, 20 is slightly sloped in relation to the respective outer surface 22, such that each wall 18, 20 defines a tapered thickness along a height thereof, from a thicker end nearest the slab 12 to a thinner end farthest from the slab 12. In other various example embodiments of the present general inventive concept, each respective outer surface 22 of each wall 18, 20 may be slightly sloped in relation to the respective inner surface 26 to define such a tapered thickness along the height thereof. In still other various example embodiments, both inner and outer surfaces 26, 22 may be sloped to define the tapered thickness. Such a tapered thickness allows for easier extraction from molds used to form such modules.

Figure 2:
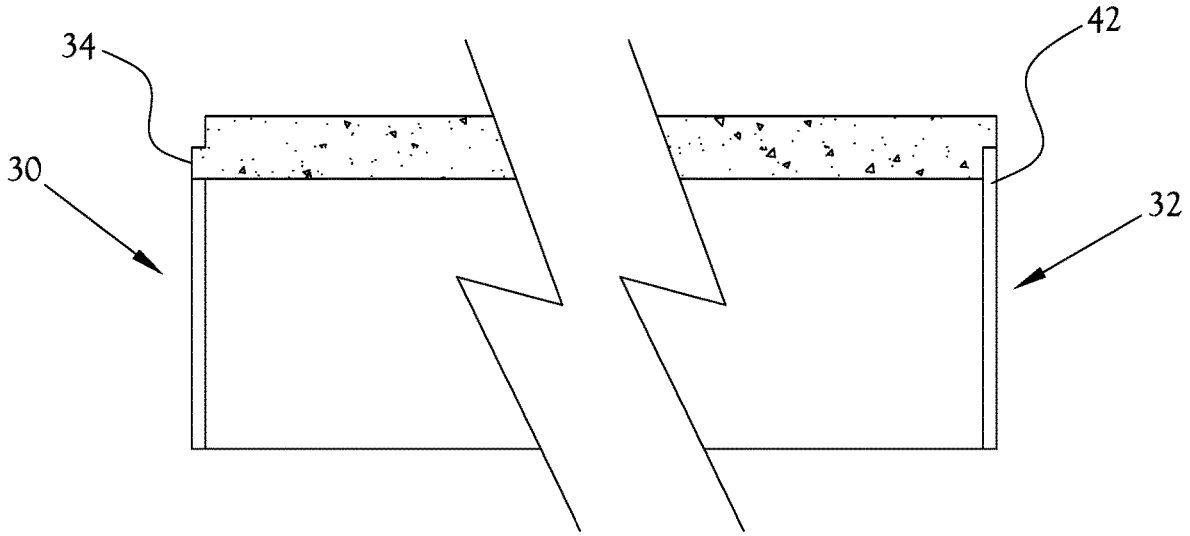
FIG. 2 illustrates the lip and groove configuration of the ends of the modular precast concrete structure illustrated in FIG. 1.

As indicated above, the module 10 defines first and second ends 30, 32. In various example embodiments, the first end 30 of each module 10 may be shaped to mate with a second end 32 of an adjacent module 10, such that a joint may be formed between modules placed in an end-to-end fashion. For example, in the example embodiment illustrated in FIG. 1, the first end 30 defines a lip 34 extending outwardly about an inner perimeter of the first end 30, along corresponding adjacent edges 36, 15, 40 of the first wall 18, slab 12, and second wall 20, respectively. Similarly, the second end 32 may define a groove 42 extending inwardly about an inner perimeter of the second end 32, along corresponding adjacent edges 44, 17, 48 of the first wall 18, slab 12, and second wall 20, respectively. FIG. 2 illustrates a side view of the lip 34 and groove 42 configuration of the ends of the modular precast concrete structure illustrated in FIG. 1. Thus, as further illustrated in the figures discussed herein, upon placement of two modules 10 in an end-to-end configuration with the first end 30 of one module adjacent the second end 32 of the other module, the lip 34 of the first end 30 of the first of the modules is received within the groove 42 of the second end 32 of the second of the modules. In this manner, multiple modules 10 may be placed, adhered, and/or fastened in an end-to-end configuration to form a continuous concrete structure defining an upper concrete surface supported by the cooperating side walls.

In the example embodiment illustrated in FIG. 1, a bearing ledge 28 is defined along the outer surface 22 of the second wall 20. The bearing ledge 28 defines an upper bearing surface 50 extending generally perpendicularly outwardly from the outer surface 22 of the second wall 20. In various embodiments, the bearing surface 50 extends in a plane slightly lower than the upper surface 24 of the slab 12, and in the illustrated embodiment, the bearing surface 50 extends in a coplanar relationship with a bottom surface of the slab 12. Various example embodiments of the present general inventive concept may provide differently configured bearing surfaces such as, for example, non-continuous bearing surfaces along the length of the module. Various example embodiments may provide such bearing surfaces on each side of the module 10. In the illustrated embodiment, the second wall 20 further defines a through opening 52 proximate a lower edge 54 thereof. In various example embodiments, the through opening 52 defines a parabolic or catenary arch shape extending upward from, and opening to, a lower edge of the second wall 20. In other example embodiments, the through opening 52 may embody other shapes, such as a circular shape or the like, and may in various embodiments be completely bounded by the second wall 20. Various example embodiments of the present general inventive concept may provide modules with such through openings on both sides of the module 10, multiple through openings on one or both sides of the module 10, and so on.

Figure 3:
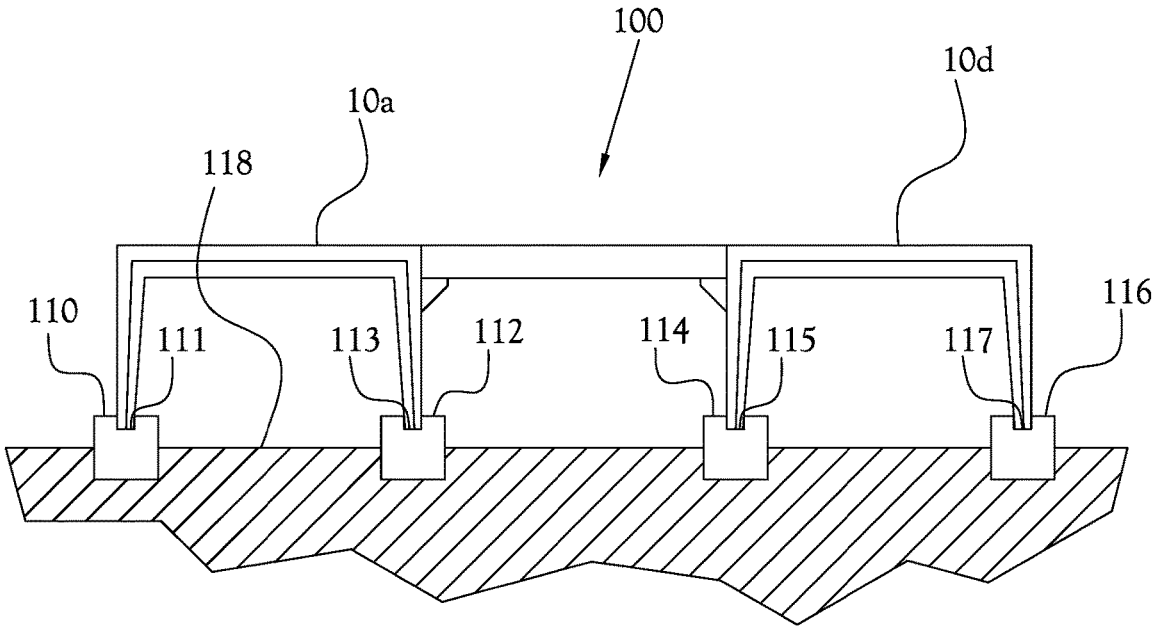
FIG. 3 illustrates a subsurface storage basin using a plurality of the modular precast concrete structures illustrated in FIG. 1 according to an example embodiment of the present general inventive concept.
Figure 4:
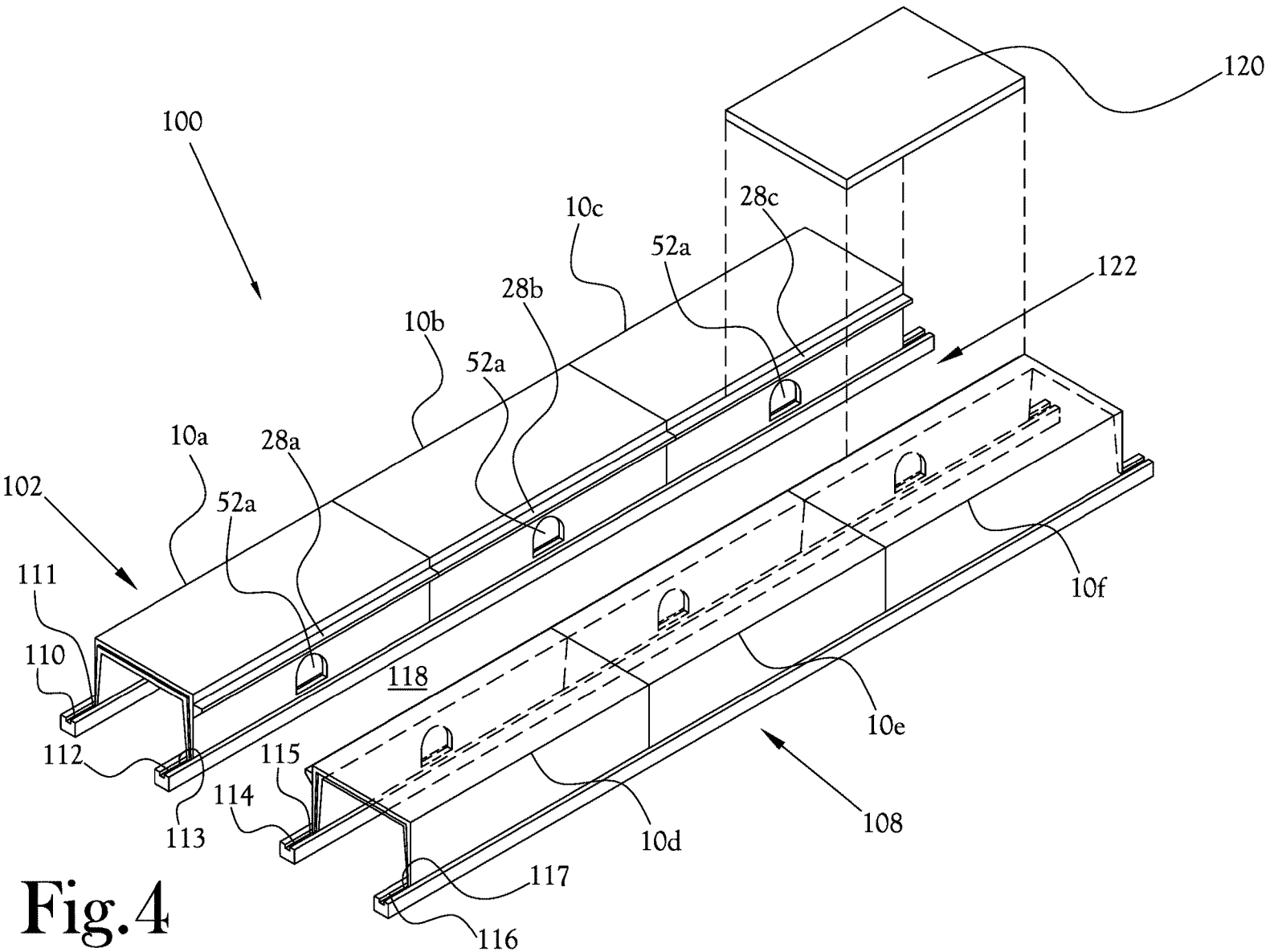
FIG. 4 illustrates a partially exploded perspective view of the subsurface storage basin illustrated in FIG. 3.

FIG. 3 illustrates a subsurface storage basin using a system including plurality of the modular precast concrete structures illustrated in FIG. 1 according to an example embodiment of the present general inventive concept, and FIG. 4 illustrates a partially exploded perspective view of the subsurface storage basin system illustrated in FIG. 3. According to the example embodiment illustrated in FIGS. 3-4, a subsurface storage basin 100 is provided comprising a plurality of modules, illustrated generally at 10 in the figures. In the illustrated embodiment, the subsurface storage basin system includes a plurality of linear footings 110, 112, 114, 116, with each of the footings arranged in a generally parallel-planar, spaced apart relationship with the remaining footings. The various footings 110, 112, 114, 116 rest upon a bed of compacted gravel 118. A first plurality of modules 10*a*, 10*b*, 10*c* are arranged in the above-discussed end-to-end configuration to form a first row of joined modules 102. That is, a second end 32*a* of a first module 10*a* is joined adjacent a first end 30*b* of a second module 10*b*, and a second end 32*b* of the second module 10*b* is joined adjacent a first end 30*c* of a third module 10*c*. Likewise, a second plurality of modules 10*d*, 10*e*, 10*f* are arranged in the above-discussed end-to-end configuration to form a second row of joined modules 108. That is, a first end 30*d* of a fourth module 10*d* is joined adjacent a second end 32*e* of a fifth module 10*e*, and a first end 30*e* of the second module 10*e* is joined adjacent a second end 32*f* of a third module 10*f*. The various first walls 18*a*, 18*b*, 18*c* of the first row of modules 102 rest upon the first footing 110, and the various second walls 20*a*, 20*b*, 20*c* of the first row of modules 102 rest upon the second footing 112. The various second walls 20*d*, 20*e*, 20*f* of the second row of modules 108 rest upon the third footing 114, and the various first walls 18*d*, 18*e*, 18*f* of the second row of modules 108 rest upon the fourth footing 116. Thus, the first and second rows of modules 102, 108 are arranged in a side-by-side, spaced apart relationship, with each bearing ledge 28*a*, 28*b*, 28*c* of each first row of modules 102 facing a respective bearing ledge 28*d*, 28*e*, 28*f* of each second row of modules 108. Each of the footings 110, 112, 114, 116 may be provided with respective footing grooves 111, 113, 115, 117 that are configured to receive the lower edges 54 of the respective first and second walls resting on the footings 110, 112, 114, 116. Due to these lower edges 54 being received in the respective footing grooves 111, 113, 115, 117, the modules are easily placed in the desired position indicated by the footing grooves 111, 113, 115, 117, and are provided a more secure footing that inhibits any shifting of the modules. Lateral movement of the modules may be inhibited simple by the resting of the lower edges in the footing grooves, and in various example embodiments the footing grooves may be provided with one or more closed ends to also inhibit movement of the modules along the direction of the footing grooves. The footing grooves 111, 113, 115, 117 may be formed in the footings 111, 112, 114, 116 during casting. In various example embodiments of the present general inventive concept, the footing grooves 111, 113, 115, 117 may be formed, or keyed, to correspond to the lower edges 54 of the side walls of the modules such that the lower edges 54 are in register with the footing grooves 111, 113, 115, 117 when received therein. Thus, in various example embodiments the footing grooves 111, 113, 115, 117 may be formed to taper in thickness toward the bottoms of the footing grooves 111, 113, 115, 117 to correspond to tapered lower edges 54 of the side walls, or first and second walls. In various example embodiments the footing grooves 111, 113, 115, 117 may be formed to different tiers inside the footing grooves 111, 113, 115, 117 to correspond to lower edges 54 that are configured to otherwise form clamshell fittings with other inverted modules, as described herein.

In the example embodiment illustrated in FIG. 4, a plurality of spanning slabs 120 are provided, with each spanning slab 120 having a first end resting on one of the bearing ledges 28*a*, 28*b*, 28*c* of the first row of modules 102 and a second end resting on a corresponding opposite bearing ledge 28*d*, 28*e*, 28*f* of the second row of modules 108. In this manner, each spanning slab 120 spans generally between corresponding upper concrete slabs 12 of the first and second row of modules 102, 108. Additionally, each spanning slab 120 is configured to abut an adjacent spanning slab 120 in a side-by-side relationship, such that the spanning slabs 120 cooperate with one another and with the upper concrete slabs 12 to define a continuous, upper concrete surface of the storage basin 100. In various example embodiments, each spanning slab 120 may define a portion of a joint, such as for example a portion of a tongue-and-groove connection or the like, along a respective side edge thereof, which may be used to join each spanning slab 120 to an adjacent spanning slab. For example, in the illustrated embodiment, each spanning slab 120 defines a first side edge having a groove defined along a length thereof. Each spanning slab further defines a second side edge having a tongue defined along a length thereof. The tongue of each second side edge is sized, shaped, and configured along the length of the second side edge so as to be received within the groove of the first side edge of an adjacent spanning slab 120 when the two slabs are placed in a side-by-side, adjacent configuration. Thus, the slabs 120 may be joined to one another in this configuration. In the example embodiment illustrated in FIG. 4, through openings 52*a* are formed along at least one side of the end to end connected modules. The through openings 52*a* are formed with an arched upper area, and extend from a lower lip that extends along the lower edges 54 of the respective side walls. Thus, the through openings 52*a* are geometric shapes completely enclosed by the sidewalls of the modules, rather than extending to an open lower edge such as the through openings 52 illustrated in FIG. 1. With such a formation, a desired height of the lip formed in the side walls may be provided so as to maintain a desired flow level in the various modules before spilling over outside of the module run through the through openings 52*a*. Other shapes of the through openings may be formed, as well as different numbers of such openings, in various example embodiments of the present general inventive concept.

Figure 5:
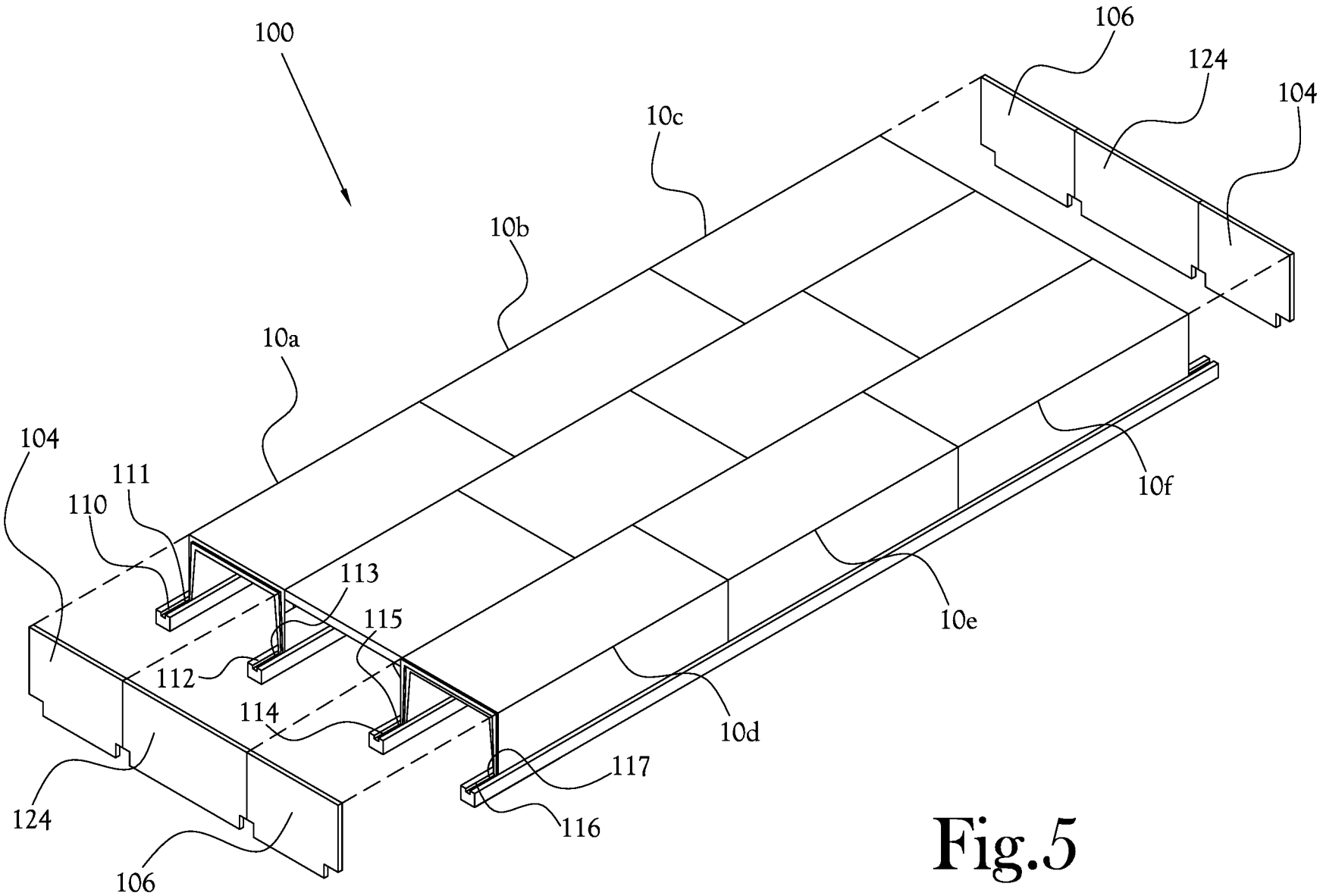
FIG. 5 illustrates a partially exploded perspective view of a subsurface storage basin according to another example embodiment of the present general inventive concept.

In various embodiments, a plurality of capping walls may be provided to close the end portions of the subsurface storage basin. FIG. 5 illustrates a partially exploded perspective view of a subsurface storage basin according to another example embodiment of the present general inventive concept. In the example embodiment illustrated in FIG. 5, a plurality of end cap walls 104, 106 are provided, with each end cap wall extending along a respective end of the first and second row of modules 102, 108. For example, in the illustrated embodiment, a first end cap wall 104 is received within, and joined to, the first end 30*a* of the first module 10*a*, and a second end cap wall 106 is received within, and joined to, the second end 32*c* of the third module 10*c*. Thus, the end cap walls 104, 106 cooperate with the various walls 18, 20 and upper slabs 12 of the modules 10 to enclose an interior space within the row of modules. In various embodiments, each end cap wall 104, 106 defines a suitable shape to allow the end cap wall to mate with and engage a respective end 30, 32 of a corresponding module 10, such that the end cap wall 104, 106 may be joined to a corresponding module end. For example, in one embodiment, each second end cap wall 106 defines a lip extending about a perimeter thereof which is configured to be received within and engage the groove 42 defined about the corresponding second end 32 of the corresponding module 10. Likewise, each first end cap wall 104 defines a groove about a perimeter thereof which is configured to receive and engage the lip 34 defined about the corresponding first end 30 of the corresponding module 10.

In the illustrated embodiment, additional side walls 124 are provided extending between corresponding first and second end cap walls 104, 106 of each first and second row of modules 102, 108, such that the spanning slabs 120 cooperate with one another and with the side walls 124 to enclose an interior space 122 between the first and second row of modules 102, 108. As discussed above, each of the various modules 10 defines a through opening 52 which, in the illustrated embodiment, provides access along a lower edge 54 of the respective module 10 between the interior of the module 10 and the interior space 122 of the storage basin 100. Thus, in the above-discussed configuration, each of the respective interiors of the various modules 10 cooperates with the interior space 122 between the first and second row of modules 102, 108 to define an interior of the storage basin 100.

From the foregoing, it will be recognized that the above-discussed modules 10 may be arranged in the above-discussed configuration of rows 102, 108, with the various spanning slabs 120 and side walls 124 extending therebetween and the various end cap walls 104, 106 extending along respective ends of the rows 102, 108, such that the aforesaid components cooperate to define a subsurface storage basin 100 having a unified interior space 122 adapted to hold a quantity of surface water runoff. The subsurface storage basin 100 may, in various applications, be installed in a subsurface location, such as beneath a parking lot or building. Surface water runoff may be directed via suitable channels to the interior space 122 of the basin 100 by way of a suitable opening in an exterior wall or upper slab of the basin 100, and thereafter, such directed surface water runoff may flow throughout the interior space 122 via the various through openings 52 in the modules 10. In various embodiments, the specific distance of separation between the rows 102, 108 of modules 10 may be selected in order to optimize the strength and size of the basin 100 while minimizing the amount of materials needed to construct the basin 100. For example, in various example embodiments in which the basin 100 is expected to support a relatively heavy load thereabove, the rows 102, 108 and corresponding footings 110, 112, 114, 116 may be placed relatively close together, and relatively short spanning slabs 120 may be used therebetween. Thus, each of the various walls 18, 20 of the modules 10 is positioned relatively close together, such that the basin 100 is capable of supporting the relatively heavy load. In other embodiments, in which the basin 100 is expected to support only a relatively light load, the rows 102, 108 and corresponding footings 110, 112, 114, 116 may be placed relatively far apart, and relatively long spanning slabs 120 may be used therebetween. Such embodiments may provide a relatively larger interior space 122 of the basin 100 while allowing the basin 100 to be constructed using a relatively minimal amount of materials, as compared to various prior art modular subsurface storage basin systems. Those skilled in the art will recognize various additional factors which may contribute to the selection of spacing between the rows 102, 108 of modules 10. For example, in several embodiments, each of the spanning slabs 120 is a "pre-stressed" concrete slab of the type designed to exhibit increased flexural strength, and thus to support greater loads, over conventional concrete slabs. In such embodiments, it will be recognized that the rows 102, 108 of modules 10 may be spaced an even greater distance apart without sacrificing support strength of the resulting basin 100. In other embodiments, each of the spanning slabs 120 is a conventionally reinforced concrete slab. In various example embodiments the modules 10 may be formed with bearing ledges 28 on each of the side walls 18, 20 so that multiple rows of the modules 10 may be used abreast of one another with spanning slabs 120 between each of the rows.

As discussed above, the basin 100 may, in various embodiments, be installed above a porous base, such as the above-discussed gravel base 118, wherein surface water runoff stored within the interior space 122 may be allowed to infiltrate the base and seep into the surrounding ground. In various example embodiments, one or more overflow openings may further be provided to allow for additional surface water runoff stored within the basin 100 to be released therefrom at a controlled rate. In other various example embodiments, a substantially non-porous base may be provided along a lower surface of the basin 100, such that a majority, or substantially all, of the surface water runoff directed into the interior space 122 may be retained for further use, such as for grey water use. For example, in one embodiment, each of the above-discussed footings 110, 112, 114, 116 may be provided along a concrete slab-on-grade. Thus, the slab-on-grade cooperates with the modules 10 and other components of the basin 100 to create a relatively water-impervious capsule within which surface water runoff may be stored. In various embodiments, one or more filter media may be provided along the base within the basin 100 to allow water flowing therethrough to be filtered by the media. For example, in several embodiments in which the above-discussed footings 110, 112, 114, 116 are provided along a concrete slab-on-grade, the basin 100 is at least partially filled with a gravel and/or sand filter media, such that as water flows into and through the basin 100, at least a portion of the water flows at least partially through the media and is thereby filtered by the media. Those skilled in the art will recognize numerous variations and types of media, such as for example conventional or activated charcoal, coral or volcanic rock media or other porous stone, biological filter media, porous fabrics or other membranes, or the like, which may be used without departing from the spirit and scope of the present general inventive concept.

Additionally, in various embodiments, one or more weirs may be provided within the basin 100 in order to allow compartmentalization of the interior space of the basin 100, for example to allow the basin 100 to define multiple interior chambers for housing different types of filter media. Such weirs may, in various embodiments, define openings or other structures which allow water to spill over from one chamber to the next within the basin 100, before eventually exiting the basin 100. Thus, for example, in one embodiment, the basin 100 may define a first "settling" chamber, in which water is retained and heavy particulates are allowed to settle from the water therein. A spill opening may be provided which, once the settling chamber becomes full, allows overflowing settled water to spill into an adjacent second "coarse filtration" chamber. Such course filtration chamber may be filled, for example, with coarse gravel and may be used to further filter large particulates from the water therein. Additional openings in additional weirs may be provided such that water in the course filtration chamber may spill over into a subsequent chamber, which may then lead to a subsequent chamber, etc., with each subsequent chamber containing a different filter media which may be used to accomplish finer and finer filtration of the water travelling through the basin 100. Eventually, an end chamber may be provided, in which water entering the end basin has undergone filtration and ready for use. Therein, the filtered water may be stored for subsequent use as discussed above, or in other embodiments, may be discharged directly from the basin 100.

Figure 6:
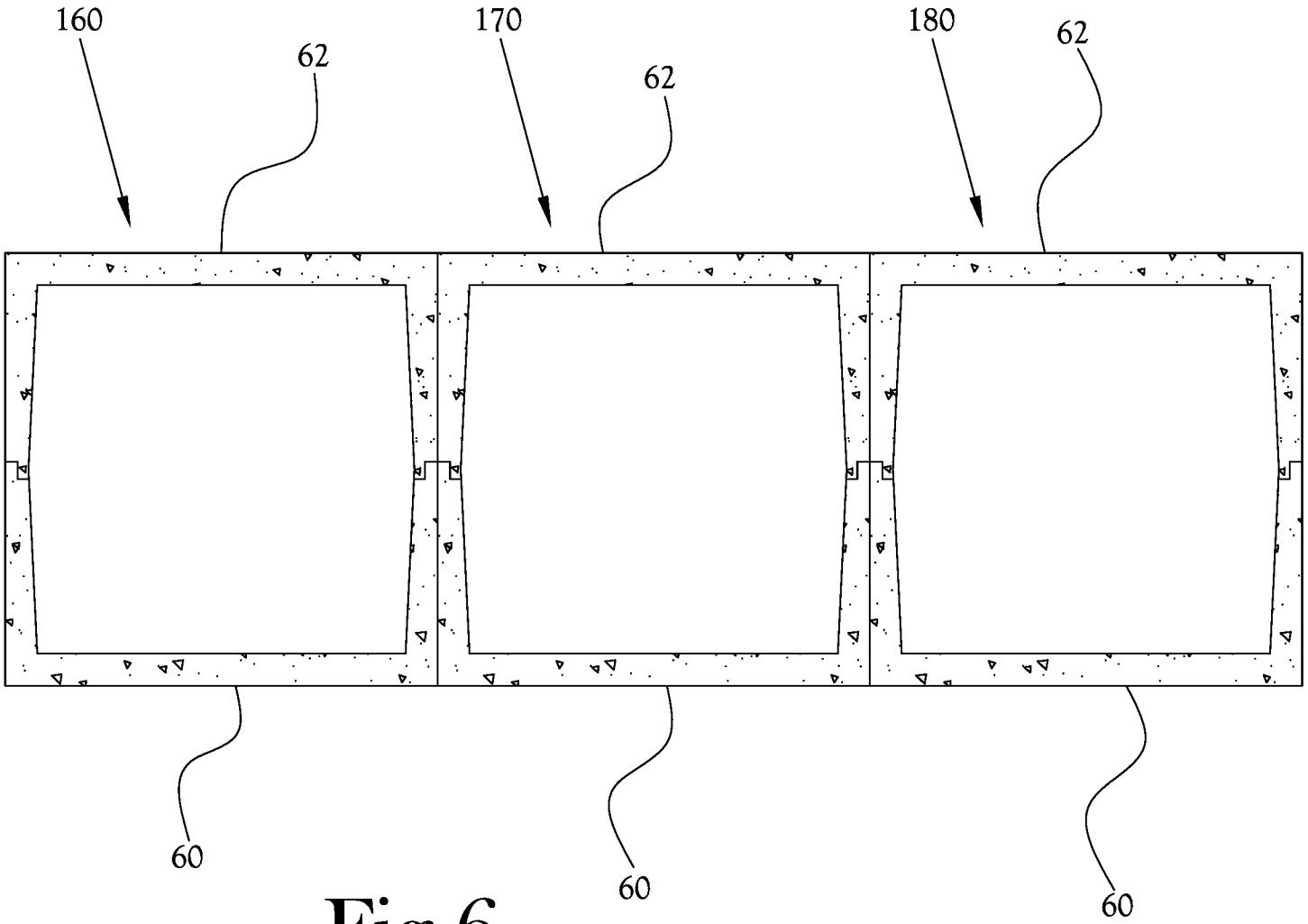
FIG. 6 illustrates a subsurface storage basin using a plurality of modular precast concrete structures according to yet another example embodiment of the present general inventive concept.

FIG. 6 illustrates a subsurface storage basin using a plurality of modular precast concrete structures according to yet another example embodiment of the present general inventive concept. In the example embodiment illustrated in FIG. 6, a basin is provided in which the various rows 102, 108 of modules 10 are constructed using pairs of opposing modules 60, 62 arranged in a "clam shell" configuration to create an encapsulation comprising upper and lower concrete slab surfaces with support walls extending therebetween. Specifically, in the example embodiment of FIG. 6, each row 160, 170, 180 of modules comprises a bottom layer of modules 60 and a top layer of modules 62. Each module 60 in each bottom layer is inverted, that is, positioned such that the above-discussed slab 12 extends along a lower surface of the module, with the side walls 18, 20 extending upwardly therefrom. Each module 62 in each top layer is positioned above and mated with a corresponding module of the bottom layer, such that the lower edge of each side wall 18, 20 of each top layer module rests upon, and extends along, a corresponding upper edge of a corresponding side wall 18, 20 of a corresponding bottom layer module. More specifically, in one embodiment, each lower edge of each first side wall 18 of each top layer module rests upon and extends along the upper edge of the first side wall 18 of the corresponding bottom layer module, and likewise, each lower edge of each second side wall 20 of each top layer module rests upon and extends along the upper edge of the second side wall 20 of the corresponding bottom layer module. Thus, each pair of modules arranged in this "clam shell" configuration cooperates to define an overall rectangular channel shape. Furthermore, in this configuration, each pair of through openings 52 defined along the mated second side walls 20 cooperate to define a unified through opening providing access to and from the interior of the modules.

In various embodiments, each of the mated lower/upper edges of the first and second side walls 18, 20 defines suitable mating surfaces, such as the above-discussed tongue and groove joint surfaces, to allow the mated surface to engage one another, such that each pair of mated modules is secured in the above-discussed "clam shell" configuration in relation to one another. Furthermore, in various embodiments, the above-discussed pairs of "clam shell" modules are arranged in end-to-end fashion as discussed above, to create rows 102, 108 of modules, which in turn may be used to fabricate one or more subsurface storage basins in the manner described above. In the example embodiment illustrated in FIG. 6, the modules 60 are configured such that the side walls terminate with an outer lip and inner groove design, while the modules 62 are configures such that side walls terminate with an outer groove and inner lip design, so that the respective modules 60, 62 are able to mate in register with one another. Various other example embodiments may provide various other mating configurations. For example, in various example embodiments each module may be configured in the same shape such that inverting one module over the other provides a mating configuration. For instance, if one wall 18 terminates with an outer lip and inner groove, and the other wall 20 terminates with an outer groove and inner lip, then two modules with the same shape can be used to form the "clam shell" configuration by simply inverting one of the modules over the other.

Figure 7:
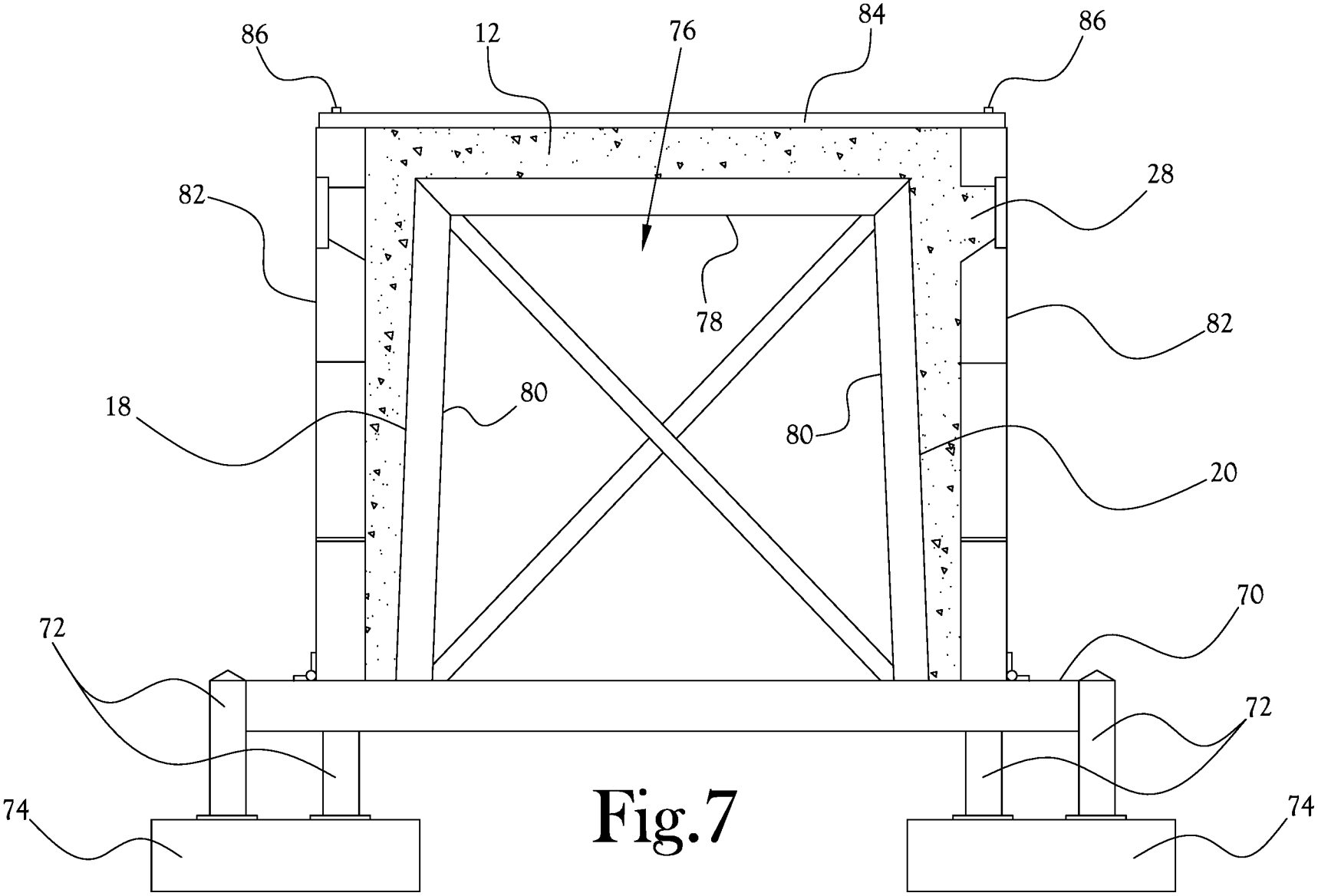
FIG. 7 illustrates a mold used to form modular precast concrete structures according to an example embodiment of the present general inventive concept.
Figure 8:
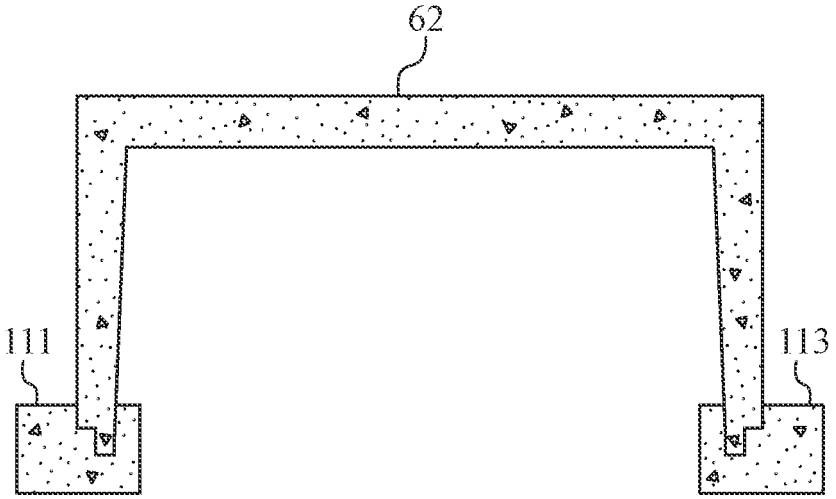
FIG. 8 illustrates a cross-sectional view of a subsurface storage basin according to the embodiment of the modular precast concrete structure shown in FIG. 6.

Several additional features of the present general inventive concept may be achieved by providing one or more apparatus for the manufacture of the above-discussed modules 10. FIG. 7 illustrates a mold used to form modular precast concrete structures according to an example embodiment of the present general inventive concept.

For example, one embodiment of a mold useful in the manufacture of the above-discussed modules 10 is illustrated in the accompanying figures. In various embodiments, the mold comprises generally a base portion 70 defining a relatively flat, horizontal surface. In the illustrated embodiment, the base portion is supported on a plurality of support rails 72, which in turn are supported above a plurality of concrete strip footing segments 74. In various embodiments, a core support frame 76 is secured along a central portion of the base portion upper surface. The core support frame 76 defines an upper horizontal surface 78 conforming generally to a lower surface of the upper concrete slab 12 of the module 10, and a pair of substantially vertical side surfaces 80. More specifically, the side surfaces 80 of the core support frame each define a slightly inward cant, such that the side surfaces 80 of the core support frame 76 conform generally to the inner surfaces of the side walls 18, 20 of the module 10.

In the illustrated embodiment, a pair of side plates 82 are hingedly secured to the base portion 70 upper surface. Each side plate 82 defines an inner surface which conforms generally to the exterior surface of a respective one of the side walls 18, 20 of the module 10. Each side plate 82 is rotatable between a first position, in which the side plate inner surface extends generally upwardly from the base portion 70 upper surface, and a second position, in which the side plate inner surface extends generally horizontally along the base portion 70 inner surface, away from the core support frame 76. In various example embodiments, each side plate 82 is securable to a top rail tension brace 84 via a plurality of pin attachments 86, such that the top rail tension brace 84 serves to temporarily and releasably secure the side plates 82 in their respective first positions. In the illustrated embodiment, the side plates 82 defines a generally flat inner surface, while at least one of the side plates 82 defines a cavity therein conforming generally to the above-discussed bearing ledge 28.

In the example embodiment illustrated in FIG. 7, at least one, and often two, dividers may be provided. Each divider conforms generally to a respective end 30, 32 of the module 10, and is securable in a configuration extending generally perpendicularly outwardly from and around the side surfaces and upper surface of the core support frame, between the inner surfaces of the side plates. Thus, each divider cooperates with the inner surfaces of the side plates, the side surfaces and upper surface of the core support frame, and the bottom portion upper surface to form a mold cavity conforming generally to the outward shape of a module 10.

In accordance with a method of manufacture of the module 10, each of the above-discussed side plates may be secured in the above-discussed first position, and each of the dividers may be positioned along a length of the mold to define a mold cavity having a desired length for a finished module 10. Additional blocking members defining additional desired features of the finished module 10 may further be positioned within the mold cavity. For example, in various embodiments, a block defining a shape conforming generally to the through opening 52 may be positioned between the core support frame and the side plate 82 corresponding to that particular side wall. As desired, additional blocking members may be placed within the mold cavity to define the above-discussed tongue and groove joints along the lower edges of the walls 18, 20 of the module 10. Thereafter, one or more structural support members, such as for example concrete rebar members, may be positioned within the mold cavity, and thereafter, the cavity may be filled with flowable uncured concrete. Additional concrete finishing techniques, such as for example vibration or the like, may be applied to the uncured concrete, whereupon the concrete may be allowed to cure, thereby forming a finished module 10. Thereafter, the side plates may be unsecured and rotated to the above-discussed second position, and the finished module 10 removed from the mold. With such a mold, the tapered inner portion of the module walls makes the task of extracting the module from the mold much easier, as contact between the inner portions of the side walls is decreased and/or eliminated as the module is lifted from the mold.

In various embodiments, prior to allowing the uncured concrete within the mold to cure, one or more lifting anchors may be positioned along an upper surface of the uncured concrete. Once cured, the lifting anchors may remain embedded in the upper surface of the slab 12, and may be used as temporary fasteners to assist in the removal of the module 10 from the mold, as well as positioning of the module 10 to form the finished subsurface storage basin.

From the foregoing description and the accompanying drawings, it will be recognized that a modular precast concrete structure is provided which is useful, for example, in the convenient manufacture of a subsurface surface runoff storage basin. Additionally, it will be recognized that a mold apparatus is provided which may be used in a method of manufacture of the above-discussed modular precast concrete structure. In various embodiments, the mold apparatus may be installed in a vehicle, such as for example along a flatbed truck or other such device, in order to allow convenient storage and transportation of the mold apparatus to a desired location for fabrication of the modular precast concrete structures.

Various example embodiments of the present general inventive concept provide a modular precast concrete structure to form a portion of a subsurface storage basin, the structure including a concrete slab having a first edge and opposite second edge, and a first concrete side wall having an outer surface extending from the first edge substantially perpendicularly to the concrete slab, and a second concrete side wall having an outer surface extending from the second edge substantially perpendicularly to the concrete slab, the outer surfaces of the first and second concrete side walls being configured to be substantially parallel, each of the first and second side walls being configured with canted inner surfaces such that the first and second side walls taper in thickness away from the slab. The modular precast concrete structure may further include at least one opening formed in at least one of the first and second side walls, the at least one opening configured to provide access to an interior of the modular precast concrete structure. The at least one opening may extend from a portion of the at least one of the first and second side walls opposite the concrete slab. The at least one opening may be wholly surrounded at a perimeter thereof by the at least one of the first and second side walls. The modular precast concrete structure may further include a bearing ledge formed on at least one of the first and second side walls, the bearing ledge configured to define a bearing surface extending substantially parallel to an upper surface of the concrete slab. The concrete slab and first and second side walls may be configured to define first and second ends of the modular precast concrete structure, each of the first and second ends being configured in a mating portion to mate to corresponding ends of an adjacent modular precast concrete structure. The modular mating portions may be tongue and groove connections. The mating portions may extend continuously along an entirety of the first and second ends of the modular precast concrete structure. The first and second side walls may be configured so as to taper to a bottom edge having a mating portion provided thereon, and the mating portion may be configured so as to register with corresponding mating portions of another modular precast concrete structure when the other modular precast concrete structure is inverted and connected to the modular precast concrete structure in a clam shell arrangement. The mating portions which may be provided on the respective bottom edges of the first and second side walls may be formed such that the mating portions of two modular precast concrete structures having identical configurations are in register when placed in the clam shell arrangement. The modular precast concrete structure may further include at least one opening formed in at least one of the first and second side walls of the modular precast concrete structures, the at least one opening configured so as to mirror a corresponding at least one opening and form a continuous opening when two modular precast concrete structures are placed in the claim shell arrangement.

Various example embodiments of the present general inventive concept provide a modular precast concrete structure system to form a modular precast concrete structure as a portion of a subsurface storage basin, the system including a concrete slab having a first edge and opposite second edge, a first concrete side wall having an outer surface extending from the first edge substantially perpendicularly to the concrete slab, and a second concrete side wall having an outer surface extending from the second edge substantially perpendicularly to the concrete slab, the outer surfaces of the first and second concrete side walls being configured to be substantially parallel, each of the first and second side walls being configured with canted inner surfaces such that the first and second side walls taper in thickness away from the slab, and a plurality of footings each configured with a footing groove along an upper surface thereof, the footing grooves configured to receive a bottom edge of at least one of the first and second side walls therein. The footings may be configured to receive the bottom edge of a plurality of first or second side walls arranged along a common direction. The footing grooves may be configured to be in register with the bottom edge of the at least one of the first and second side walls when received therein. The system may further include at least one opening formed in at least one of the first and second side walls, the at least one opening configured to provide access to an interior of the modular precast concrete structure. The at least one opening may extend from a portion of the at least one of the first and second side walls opposite the concrete slab. The at least one opening may be wholly surrounded at a perimeter thereof by the at least one of the first and second side walls. The at least one opening may be configured with an arched upper area and a straight lower edge formed by the bottom edge of the at least one of the first and second side walls. The system may further include a bearing ledge formed on at least one of the first and second side walls, the bearing ledge configured to define a bearing surface extending substantially parallel to an upper surface of the concrete slab. The concrete slab and first and second side walls may be configured to define first and second ends of the modular precast concrete structure, each of the first and second ends being configured in a mating portion to mate to corresponding ends of an adjacent modular precast concrete structure. The mating portions may be tongue and groove connections. The mating portions may extend continuously along an entirety of the first and second ends of the modular precast concrete structure. The first and second side walls may be configured so as to taper to a bottom edge having a mating portion provided thereon, the mating portion being configured so as to register with corresponding mating portions of another modular precast concrete structure when the other modular precast concrete structure is inverted and connected to the modular precast concrete structure in a clam shell arrangement. The mating portions provided on the respective bottom edges of the first and second side walls may be formed such that the mating portions of two modular precast concrete structures having identical configurations are in register when placed in the clam shell arrangement. The footing grooves may be formed with a tiered surface at the bottom to receive the bottom edge of at least one of the first and second side walls. The system may further include at least one opening formed in at least one of the first and second side walls of the modular precast concrete structures, the at least one opening configured so as to mirror a corresponding at least one opening and form a continuous opening when two modular precast concrete structures are placed in the claim shell arrangement. The first and second side walls may be configured so as to taper to a bottom edge. The footing grooves may be configured with tapered side portions to correspond to the bottom edges of the at least one of the first and second side walls to be received therein.

Various example embodiments of the present general inventive concept may provide a forming apparatus to precast a modular concrete structure used to form a portion of a subsurface storage basin, the forming apparatus including a bottom surface configured form a bottom portion of the modular concrete structure, two outer side wall members configured to form substantially vertical outer surfaces of opposing side walls of the modular concrete structure, two inner side wall members respectively facing the two outer side wall members and configured to form canted inner surfaces of the opposing side walls of the modular concrete structure so that the side walls taper in thickness toward the bottom portion of the modular concrete structure, and a top member configured to form a concrete slab having a first edge and opposite second edge from which the opposing side walls of the modular concrete structure respectively extend to the bottom portion of the modular concrete structure.

Various example embodiments of the present general inventive concept may provide a method of forming a modular concrete structure used to form a portion of a subsurface storage basin, the method including providing a bottom surface configured to form a bottom portion of the modular concrete structure, providing two outer side wall members extending from the bottom surface and configured to form substantially vertical outer surfaces of opposing side walls of the modular concrete structure, providing two inner side wall members extending from the bottom surface and respectively facing the two outer side wall members, the inner side wall members configured to form canted inner surfaces of the opposing side walls of the modular concrete structure so that the side walls taper in thickness toward the bottom portion of the modular concrete structure, providing a top member extending between the inner side wall members and configured to form a concrete slab having a first edge and opposite second edge from which the opposing side walls of the modular concrete structure respectively extend to the bottom portion of the modular concrete structure; and pouring concrete over the top member and between the respective outer and inner side wall members until a desired thickness of the formed concrete slab is reached.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams, drawings, and photographs included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, photographs, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A modular precast concrete structure system to form a modular precast concrete structure as a portion of a subsurface storage basin, the system comprising:

first, second, third and fourth linear footings arranged on a water permeable surface in a parallel, spaced apart relationship with one another, each first and second linear footing configured with a footing groove along a long dimension of an upper surface thereof, the footing grooves of the first and second linear footings each defining a canted side wall extending on a side of the footing groove closest to the other of the first and second linear footings and a vertical side wall extending along the footing groove opposite the canted side wall, each third and fourth linear footing configured with a footing groove along a long dimension of an upper surface thereof, the footing grooves of the third and fourth linear footings each defining a canted side wall extending on a side of the footing groove closest to the other of the third and fourth linear footings and a vertical side wall extending along the footing groove opposite the canted side wall;

a first row of precast concrete modules arranged in an end-to-end configuration along the first and second linear footings, and a second row of precast concrete modules arranged in an end-to-end configuration along the third and fourth linear footings, each precast concrete module comprising:

a concrete slab having a first side edge an opposite second side edge, a first end edge, an opposite second end edge, an upper surface, and an opposite lower surface, each concrete slab first end edge defining a portion of a connection configured to join with a corresponding connection of a second end edge of an adjacent precast concrete module;

a first concrete side wall having an outer surface extending downwardly from the first side edge substantially perpendicularly to the concrete slab, and a second concrete side wall having an outer surface extending downwardly from the second side edge substantially perpendicularly to the concrete slab, each of the first and second concrete side walls having a bottom edge configured to be received within a corresponding footing groove of a corresponding linear footing, the outer surfaces of the first and second concrete side walls being configured to be substantially parallel and spaced apart from one another and to register and mate with the vertical side walls of the corresponding footing grooves, each of the first and second side walls being configured with canted inner surfaces such that the first and second side walls taper in thickness away from the slab and such that the inner surfaces of the first and second side walls register and mate with the canted side walls of the corresponding footing grooves;

a bearing ledge extending from the outer surface of the first concrete side wall, the bearing ledge defining a substantially flat upper bearing surface extending perpendicularly to the outer surface of the first concrete side wall and coplanar with the lower surface of the concrete slab; and a through opening defined in, and enclosed by, the first concrete side wall below the bearing ledge, the through opening having a linear lower edge that extends parallel to the bottom edge of the first concrete side wall and an arched upper area and having a curved perimeter extending between opposite ends of the linear lower edge;

wherein each of the bearing ledges of the first row of precast concrete modules faces a bearing ledge of the second row of precast concrete modules; and a plurality of spanning slabs, each spanning slab having a first end resting on one of the bearing ledges of the first row of precast concrete modules and a second end resting on one of the bearing ledges of the second row of precast concrete modules, the spanning slabs and the concrete slabs of the precast concrete modules cooperating to form a continuous upper surface of the modular precast concrete structure system;

wherein each spanning slab has a width extending between the first and second ends thereof greater than a width of the concrete slabs of the precast concrete modules extending between the first and second concrete side walls.

2. The system of claim 1, wherein the concrete slab and first and second side walls are configured to define first and second ends of the precast concrete module, each of the first and second ends being configured in a mating portion to mate to corresponding ends of an adjacent precast concrete module.

3. The system of claim 2, wherein the mating portions are tongue and groove connections.

4. The system of claim 2, wherein the mating portions extend continuously along an entirety of the first and second ends of the precast concrete module.

5. The system of claim 1, wherein mating portions provided on the respective bottom edges of the first and second side walls are formed such that the mating portions of two modular precast concrete structures having identical configurations are in register when placed in the clam shell arrangement.

6. The system of claim 1 further comprising a porous filtration media received within at least one of the precast concrete modules between the first and second concrete side walls to allow water flowing therethrough to be filtered by the media.

7. The system of claim 6 further comprising at least one weir disposed between at least one pair of adjacent precast concrete modules, the weir defining at least two chambers in a corresponding row of precast concrete modules and at least one opening to allow water to spill over from one chamber to another within the row.

8. The system of claim 7, wherein the porous filtration media includes at least a first media having a first permeability in one chamber and a second media having a second permeability in another chamber.

* * * * *